US011799232B2

(12) United States Patent
Novak et al.

(10) Patent No.: US 11,799,232 B2
(45) Date of Patent: Oct. 24, 2023

(54) SINGLE PAIR ETHERNET COUPLER AND ADAPTER

(71) Applicant: Panduit Corp., Tinley Park, IL (US)

(72) Inventors: Benjamin S. Novak, Lockport, IL (US); Satish I. Patel, Roselle, IL (US); Roman J. Churnovic, Joliet, IL (US)

(73) Assignee: Panduit Corp., Tinley Park, IL (US)

( * ) Notice: Subject to any disclaimer, the term of this patent is extended or adjusted under 35 U.S.C. 154(b) by 22 days.

(21) Appl. No.: 17/392,979

(22) Filed: Aug. 3, 2021

(65) Prior Publication Data

US 2023/0043799 A1 Feb. 9, 2023

(51) Int. Cl.

| | |
|---|---|
| ***H01R 13/506*** | (2006.01) |
| ***H01R 13/659*** | (2011.01) |
| ***H01R 31/06*** | (2006.01) |
| ***H01R 13/28*** | (2006.01) |
| ***H01R 24/84*** | (2011.01) |

(52) U.S. Cl.

CPC ..... *H01R 13/506* (2013.01); *H01R 13/659* (2013.01); *H01R 31/06* (2013.01); *H01R 13/28* (2013.01); *H01R 24/84* (2013.01)

(58) Field of Classification Search

CPC ..... H01R 13/28; H01R 24/84; H01R 13/659; H01R 13/506; H01R 31/06

See application file for complete search history.

(56) References Cited

U.S. PATENT DOCUMENTS

| | | | | |
|---|---|---|---|---|
| 7,549,883 | B2 * | 6/2009 | Hillis | H01R 13/28 439/285 |
| 7,766,660 | B1 | 8/2010 | Chang | |
| 8,794,850 | B2 * | 8/2014 | Su | H01R 24/64 385/75 |
| 2019/0267724 | A1 * | 8/2019 | Fitzpatrick | H01R 4/245 |
| 2020/0153176 | A1 * | 5/2020 | Sparrowhawk | H01R 13/64 |

FOREIGN PATENT DOCUMENTS

| | | | |
|---|---|---|---|
| CN | 110444975 | A | 11/2019 |
| EP | 0399074 | A1 | 11/1990 |
| WO | 2020051340 | A1 | 3/2020 |

* cited by examiner

*Primary Examiner* — Briggitte R. Hammond

(74) *Attorney, Agent, or Firm* — Christopher S. Clancy; James H. Williams; Christopher K. Marlow

(57) ABSTRACT

An electrical coupler has first and second housing halves and first and second contacts retained within the first and second housing halves. Wherein the first housing half is identical to the second housing half and the first contact is identical to the second contact.

4 Claims, 18 Drawing Sheets

SINGLE PAIR ETHERNET COUPLER AND ADAPTER

FIELD OF THE INVENTION

The present invention relates generally to electrical couplers and adapters and more specifically to an electrical coupler and adapter for a single pair ethernet system.

BACKGROUND

Single pair ethernet (SPE) structured cabling enables easier media access control, eliminates risk of polarity reversal, and reduces overall termination labor. It is expected that the SPE cabling solution will become a central part of building automation development, and expanded cabling solutions will be necessary to fulfill customer needs.

What is needed is a coupler device with two female ports that can connect two existing SPE plugs together to turn two short communications cables into one long communications cable along with a fixed module that can accommodate the SPE coupler and provide the ability to mount it into communications hardware having the Panduit Mini-Com mounting interface.

SUMMARY

An electrical coupler has first and second housing halves and first and second contacts retained within the first and second housing halves, Wherein the first housing half is identical to the second housing half and the first contact is identical to the second contact.

DESCRIPTION OF THE INVENTION

Figure 1:
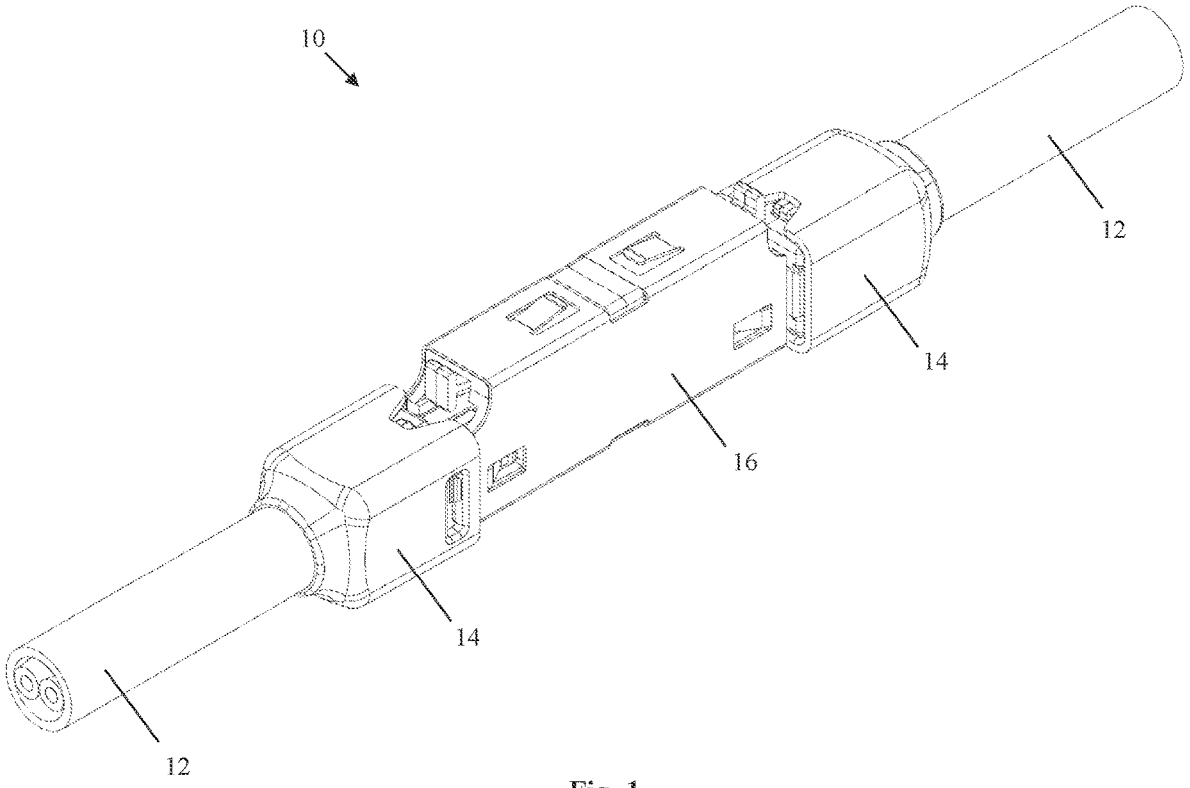
FIG. 1 is an isometric view of a communications channel.

FIG. 1 is an isometric view of communications channel 10, which includes two SPE cables 12 terminated to SPE plugs 14 connected by SPE coupler 16. Communications channel 10 can be located in cabinets, racks, zone enclosures, and other such infrastructure.

Figure 2:
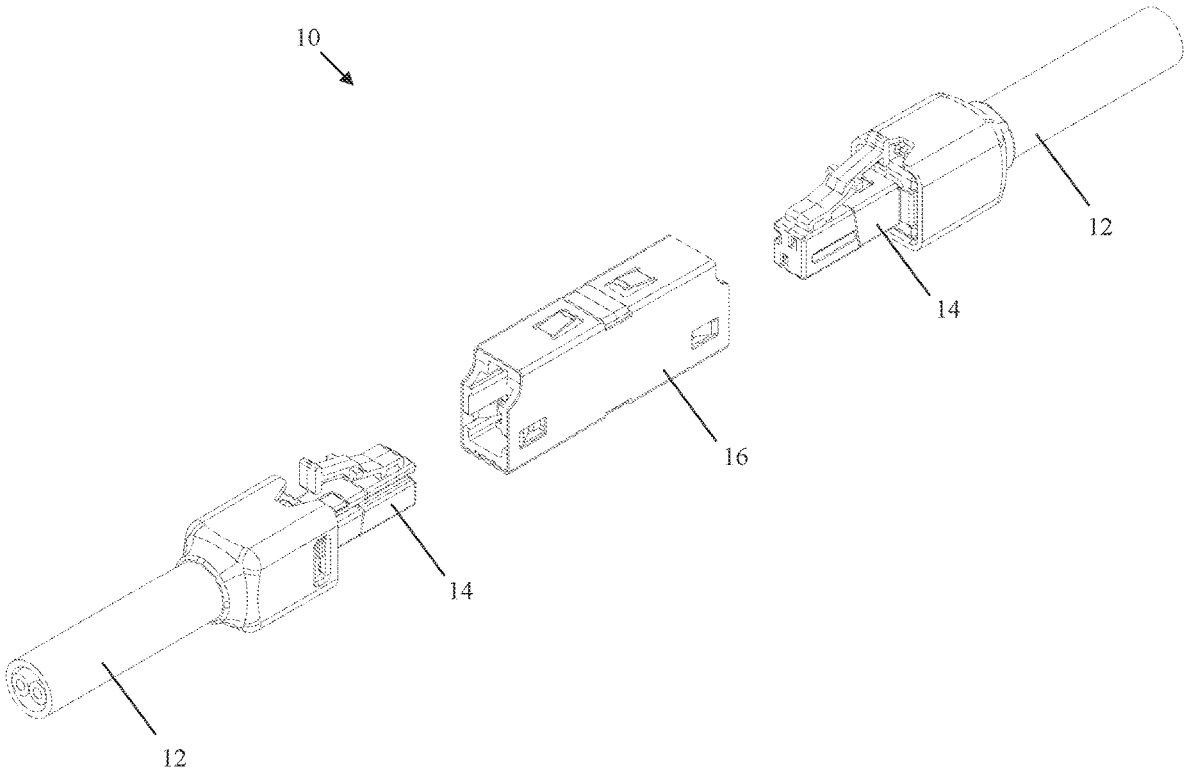
FIG. 2 is an exploded view of the communications channel of FIG. 1.

FIG. 2 is an exploded view of communications channel 10 with SPE plugs 14 removed from SPE coupler 16.

Figure 3:
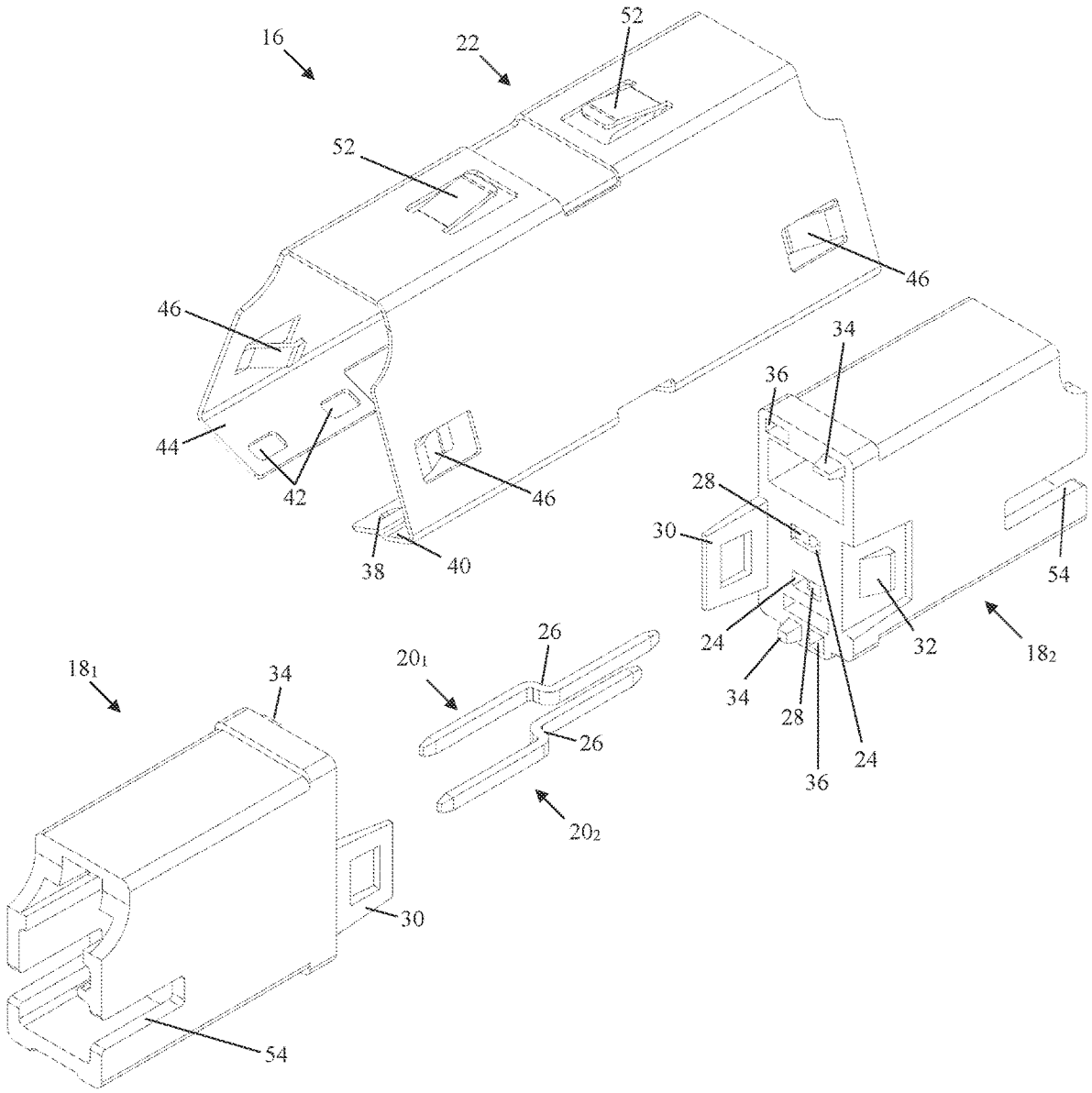
FIG. 3 is an exploded view of a single pair ethernet (SPE) coupler.
Figure 4:
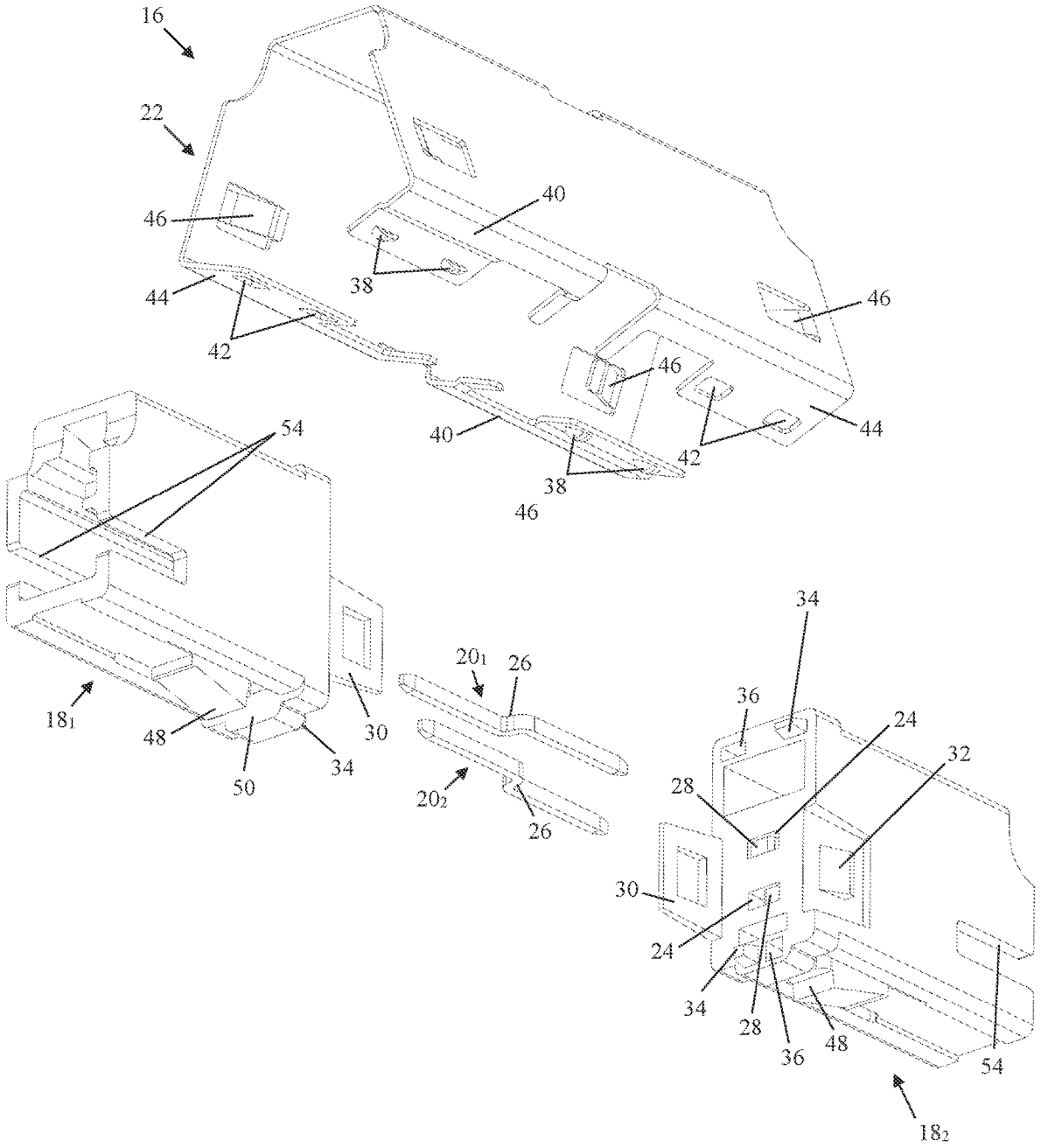
FIG. 4 is an exploded underside view of the SPE coupler of FIG. 3.

FIG. 3 is an exploded view of SPE coupler 16, which includes coupler housings $\mathbf{18}_1$ and $\mathbf{18}_2$, contacts $\mathbf{20}_1$ and $\mathbf{20}_2$, and shield wrap 22. FIG. 4 is an exploded underside view of SPE coupler 16. Shield wrap 22 is shown in an open position. Coupler housings $\mathbf{18}_1$ and $\mathbf{18}_2$ are identical. Contacts $\mathbf{20}_1$ and $\mathbf{20}_2$ are identical. Contacts 20 are slid into openings 24 of coupler housings 18 until bend 26 on contacts 20 meet with stop face 28 on coupler housings 18. Latch 30 on coupler housing $\mathbf{18}_1$ connects to catch 32 on coupler housing $\mathbf{18}_2$. Likewise, latch 30 on coupler housing $\mathbf{18}_2$ connects to catch 32 on coupler housing $\mathbf{18}_1$. Bosses 34 fit inside pockets 36 when coupler housings $\mathbf{18}_1$ and $\mathbf{18}_2$ are assembled to help align the two housings.

Shield wrap 22 is placed over the top of the assembled coupler housings 18. Louvers 38 on crimped flanges 40 snap into windows 42 on flanges 44 of shield wrap 22 when shield wrap 22 is placed over the assembled coupler housings 18. This action holds shield wrap 22 in a closed position. Shield wrap 22 is designed to help meet performance requirements laid out in IEC and TIA specifications. Wiping tabs 46 on shield wrap 22 fit into open slots 54 on coupler housings 18 to meet IEC dimensional specifications. Wiping tabs 46 on shield wrap 22 of SPE coupler 16 come into contact with SPE plugs 14 to create bonding throughout communications channel 10. Contact $\mathbf{20}_1$ routes the signal from the top wire of SPE plug $\mathbf{14}_1$ to the top wire of SPE plug $\mathbf{14}_2$ to create a continuous connection for an expanded cabling solution. Equally, contact $\mathbf{20}_2$ routes the signal from the bottom wire of SPE plug $\mathbf{14}_1$ to the bottom ire of SPE plug $\mathbf{14}_2$ to create a continuous connection for an expanded cabling solution.

Figure 5:
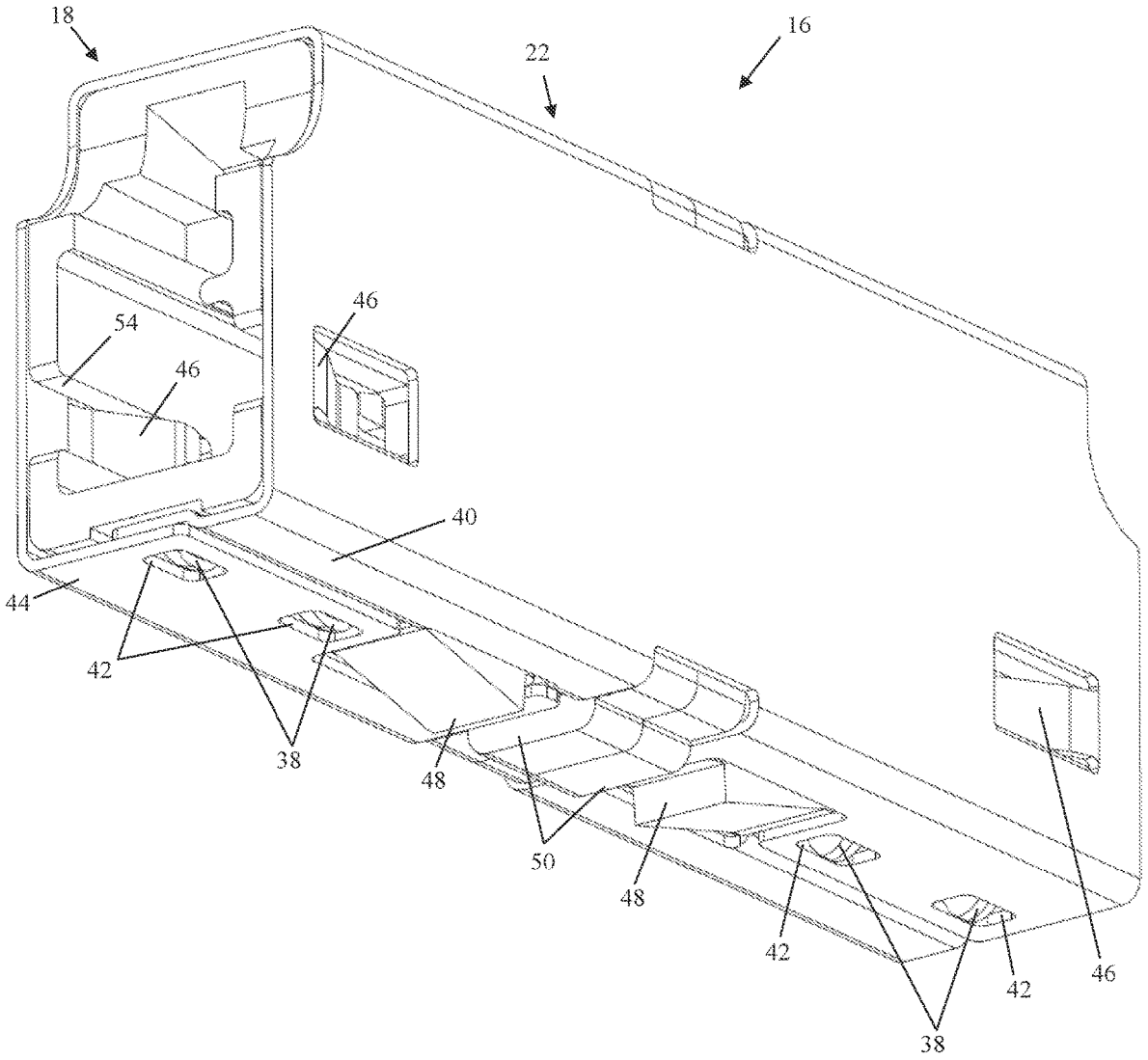
FIG. 5 is an underside view of the SPE coupler of FIG. 3.

FIG. 5 is an underside view of SPE coupler 16. Latches 48 and stop edges 50 on the bottom of coupler housings 18 of SPE coupler 16 are designed to lock SPE coupler 16 into any number of fixed modules designed to secure SPE coupler 16 in place after implementation. These modules can be located in cabinets, racks, zone enclosures, and other such infrastructure.

Figure 6:
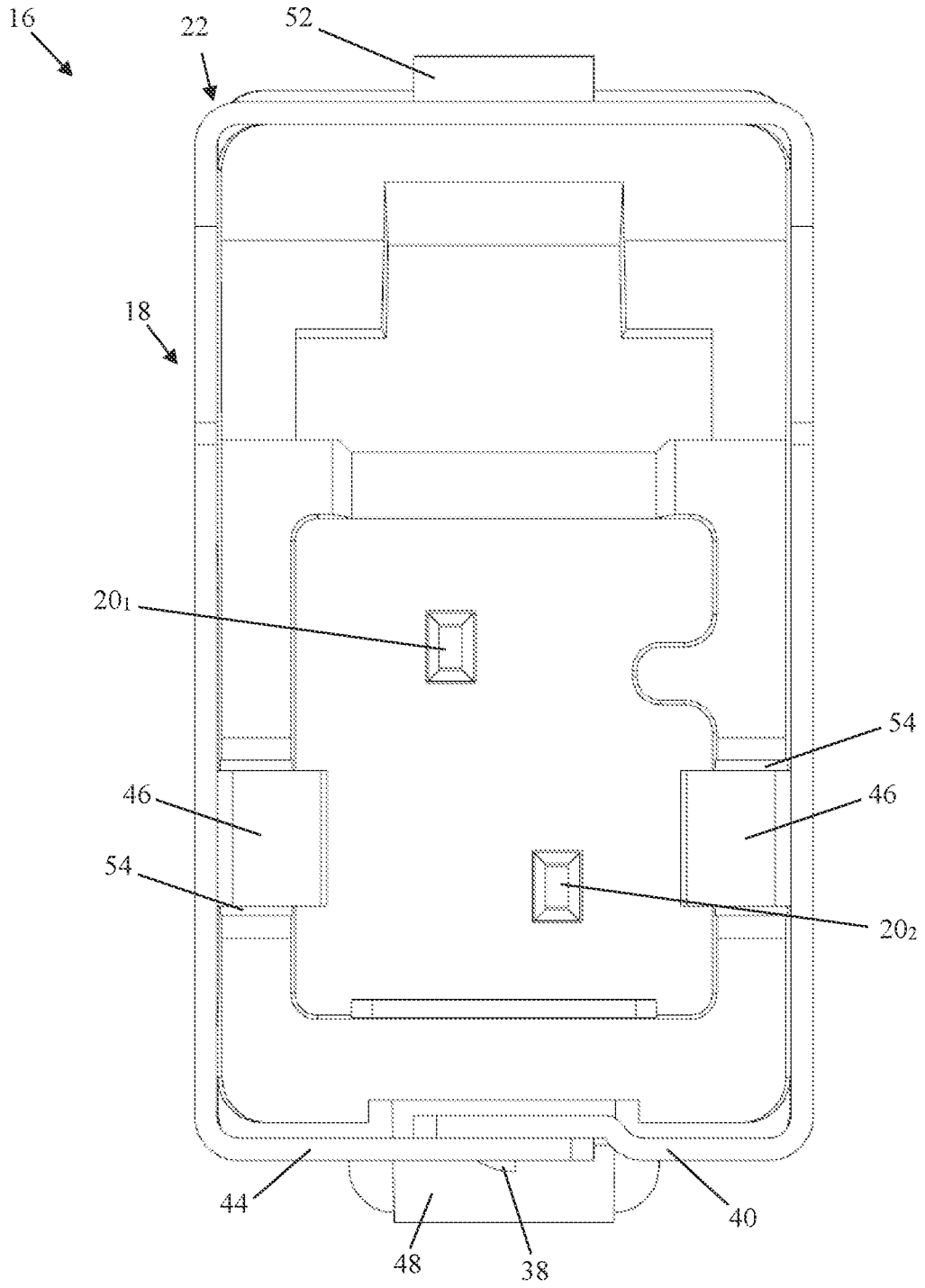
FIG. 6 is a front view of the SPE coupler of FIG. 3.

FIG. 6 is a front view of SPE coupler 16. Grounding tab 52 is designed to interact with any number of fixed modules designed to secure SPE coupler 16 in place after implementation and provide bonding throughout the communications system. SPE coupler 16 is designed to meet the fixed connector dimensional criteria described in IEC 63171-1 which will allow for proper insertion of SPE plugs 14.

Figure 7:
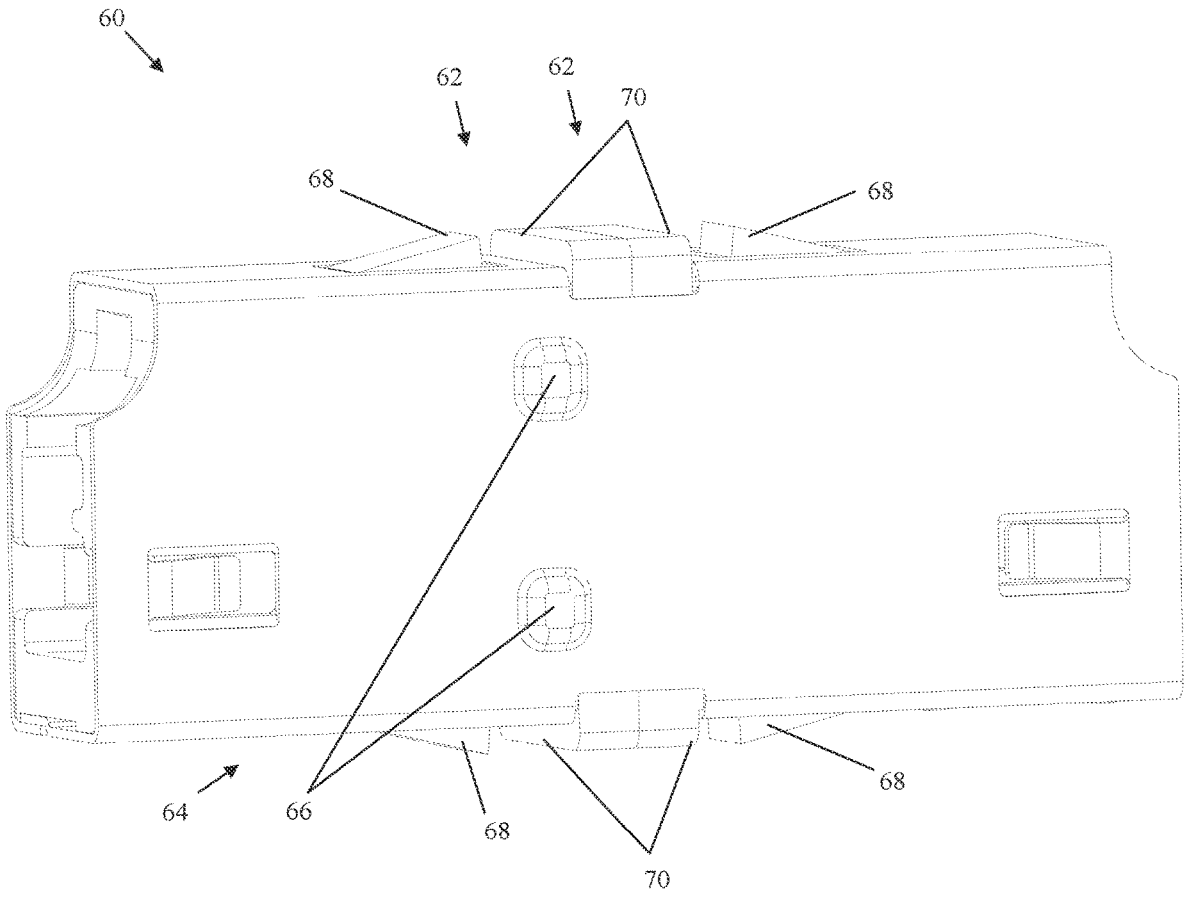
FIG. 7 is a rotated side view of an alternate embodiment of an SPE coupler.

FIG. 7 is a rotated side view of an alternate embodiment of SPE coupler 60. SPE coupler 60 would assemble and function in a manner identical to the previously described SPE coupler 16. SPE coupler 60 includes coupler housings 62, contacts 20 (not shown), and shield wrap 64. This alternate embodiment shows that coupler housings 62 can be made such that latches 68 and stop edges 70 can be positioned on either the top, the bottom, or both of coupler housings 62 to lock SPE coupler 60 into any number of fixed modules designed to secure SPE coupler 60 in place after implementation. This allows SPE coupler 60 to be installed oriented up or down. These modules can be located in cabinets, racks, zone enclosures, and other such infrastructure. SPE coupler 60 also demonstrates alternative bonding by showing that grounding features 66 on shield wrap 64 can be placed on the side surface of shield wrap 64 to interact with any number of fixed modules designed to secure SPE Coupler 60 in place after implementation and provide bonding throughout the communications system.

Figure 8:
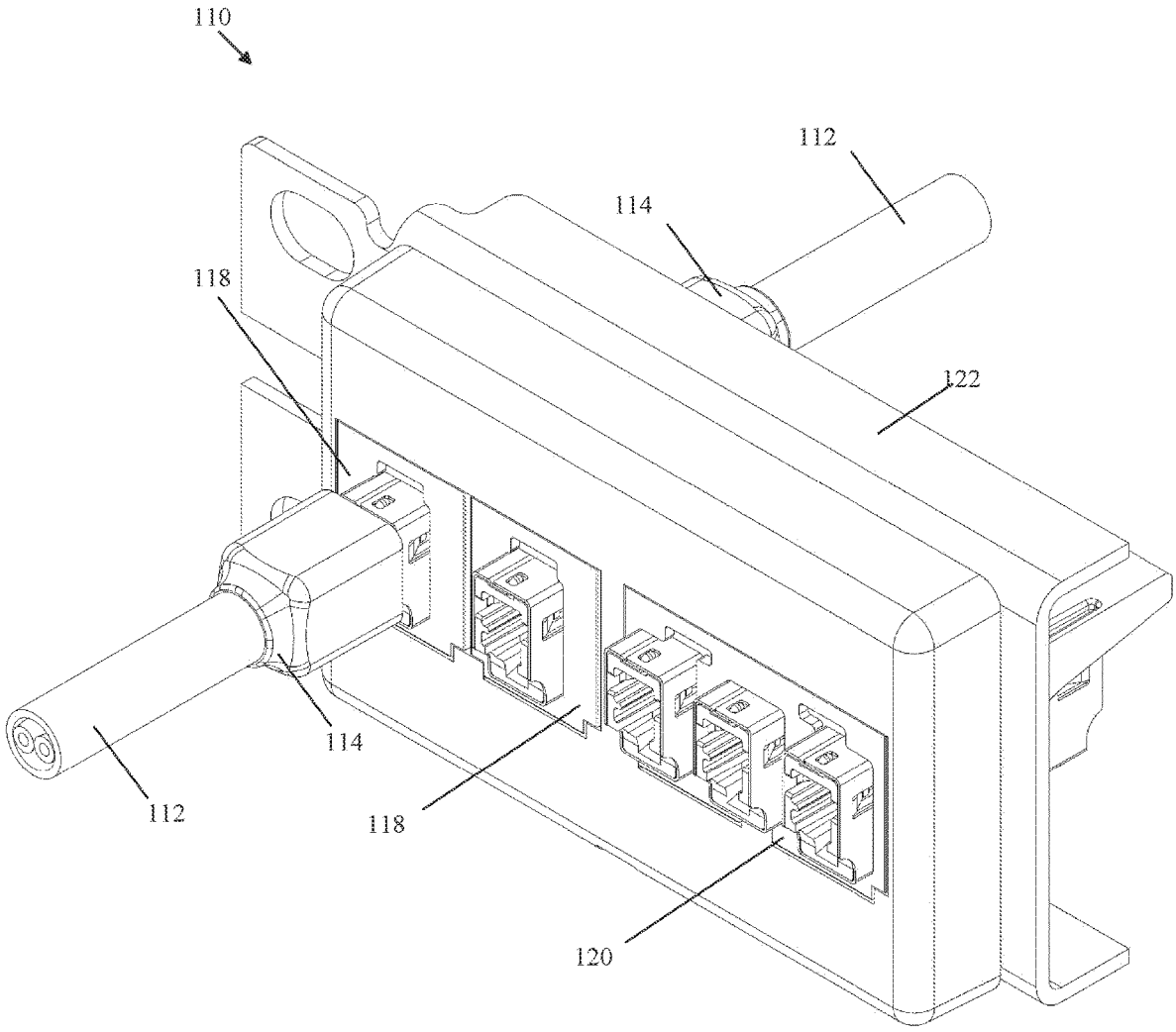
FIG. 8 is an isometric view of a communication system.

FIG. 8 is an isometric view of communication system 110, which includes SPE cables 112 terminated to SPE plugs 114, single port coupler assemblies 118, two-port coupler assembly 120, and communications hardware 122. Communications hardware 122 is illustrated as a patch panel in FIG. 8, but examples of possible communications hardware can be, but is not limited to, modular patch panels, wall faceplates, surface mount boxes, Mini-Com interface adapters, etc.

Figure 9:
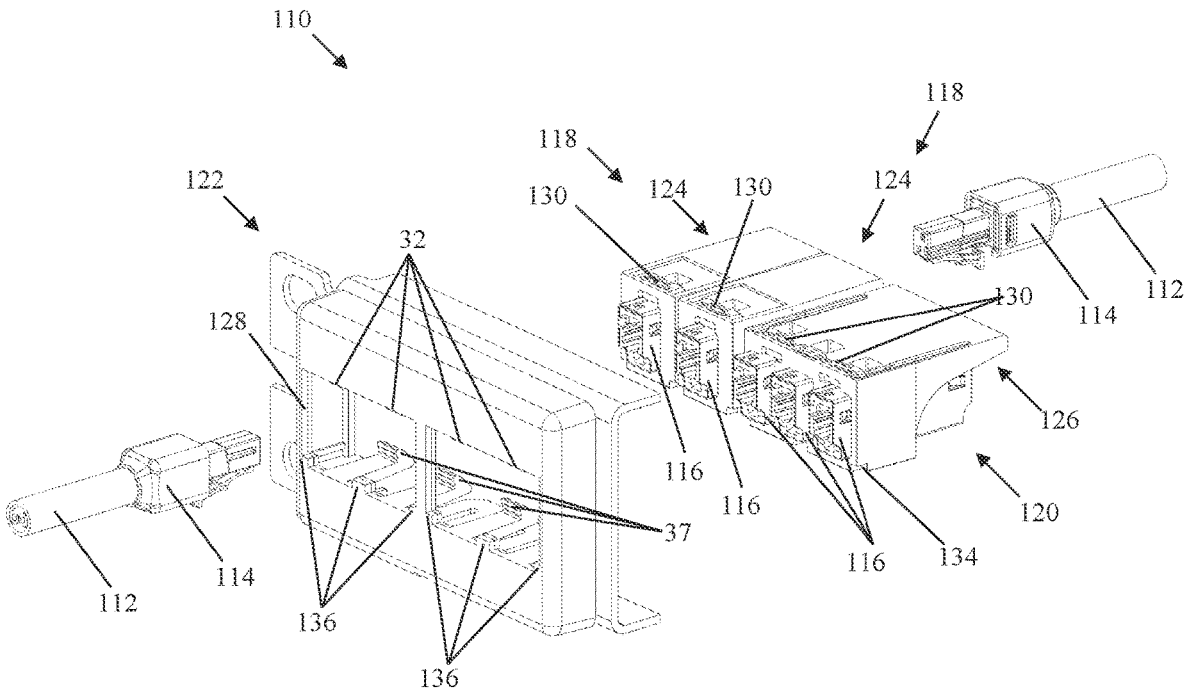
FIG. 9 is an exploded view of the communication system of FIG. 8.
Figure 10:
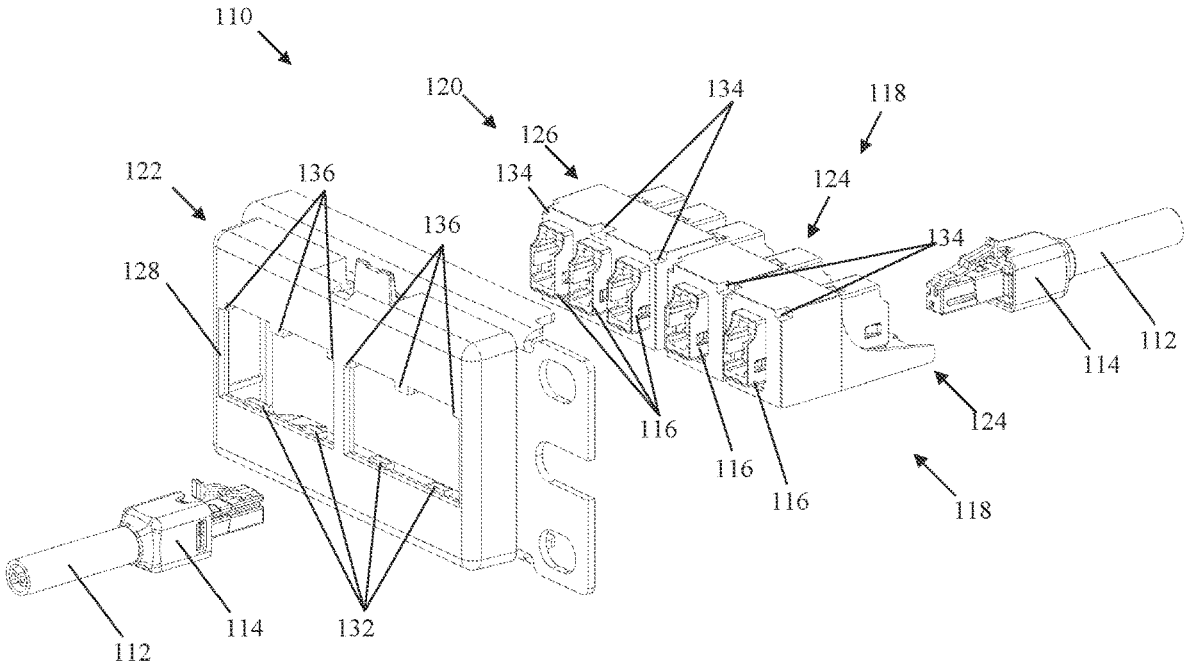
FIG. 10 is a rotated exploded view of the communication system of FIG. 8.

FIG. 9 is an exploded view of communication system 110. FIG. 10 is a rotated exploded view of communication system 110. Single port coupler assemblies 118 include SPE couplers 116 and single port Mini-Com adapters 124. Two-port coupler assembly 120 includes SPE couplers 116 and two-port Mini-Com adapter 126. Single port Mini-Com adapter 124 and two-port Mini-Corn adapter 126 have provisions to fit the Mini-Com port opening 128 on communications hardware 122. Pockets 130 on single port Mini-Corn adapter 124 and two-port Mini-Corn adapter 126 are placed on bosses 132 of communications hardware 122; then single port Mini-Corn adapter 124 and two-port Mini-Com adapter 126 are rotated forward until corner cutouts 134 contact locating geometry 136 on communications hardware 122 and latch 137 on communications hardware 122 hooks back edges 138 of single port Mini-Corn adapter 124 and two-port Mini-Corn adapter 126 to hold single port Mini-Corn adapter 124 and two-port Mini-Corn adapter 126 in place during use.

Figure 11:
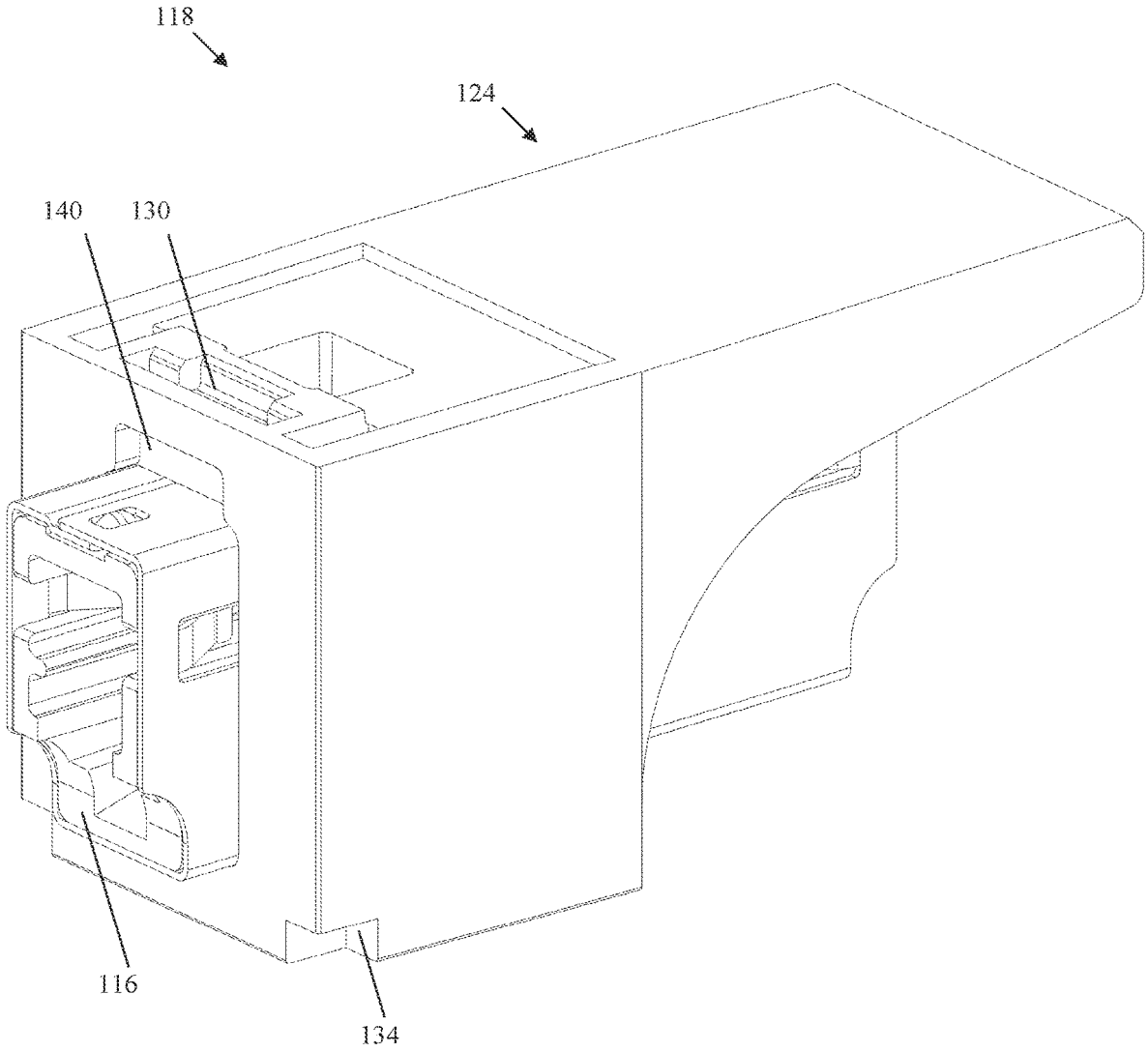
FIG. 11 is an isometric view of a single port coupler assembly.
Figure 12:
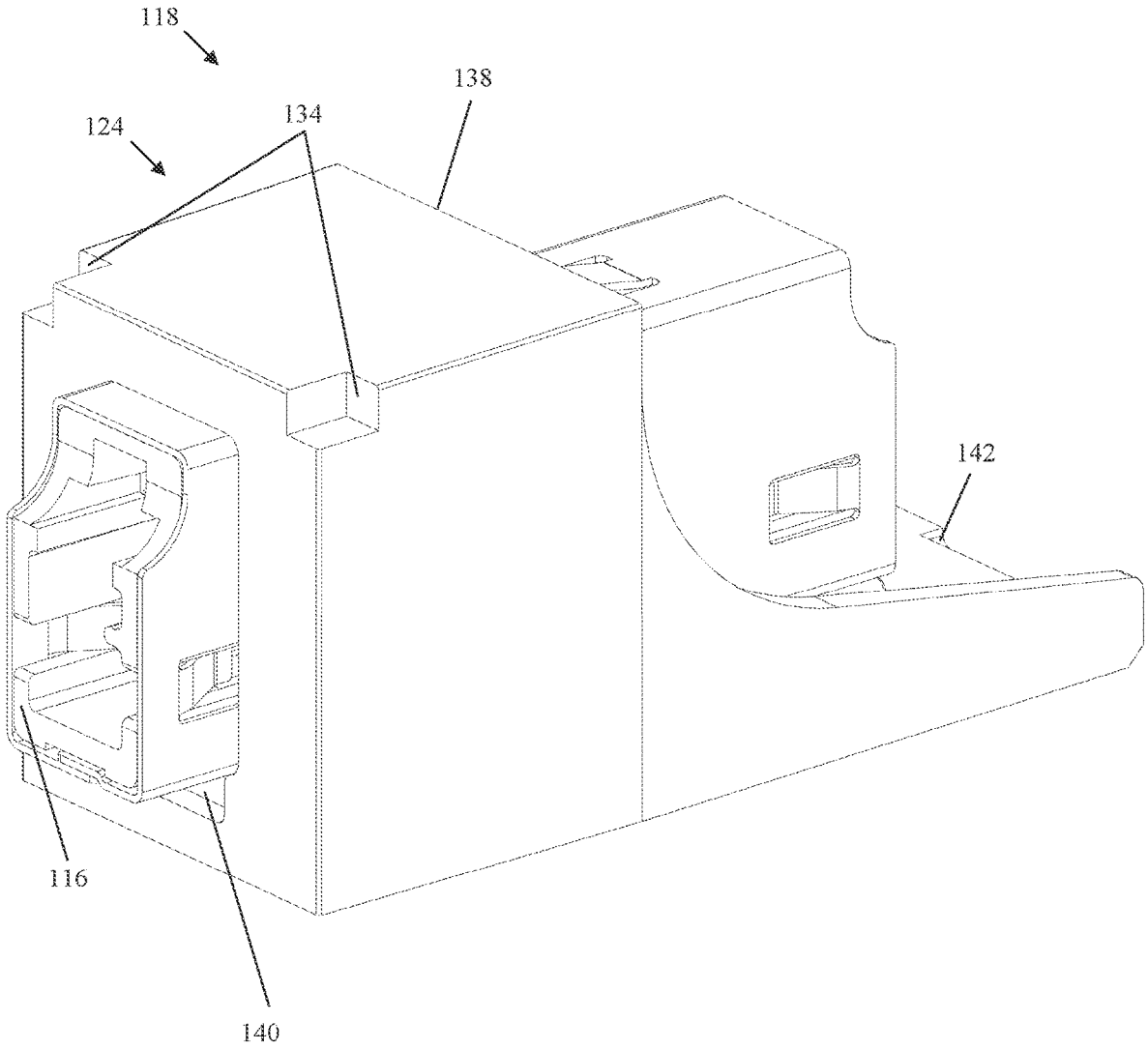
FIG. 12 is a rotated isometric view of the single port coupler assembly of FIG. 11.

FIG. 11 is an isometric view of single port coupler assembly 118. FIG. 12 is a rotated isometric view of single port coupler assembly 118. Single port Mini-Corn adapter 124 has pocket 40 and notch 142 to accommodate installation into surface mount boxes and other such equipment.

Figure 13:
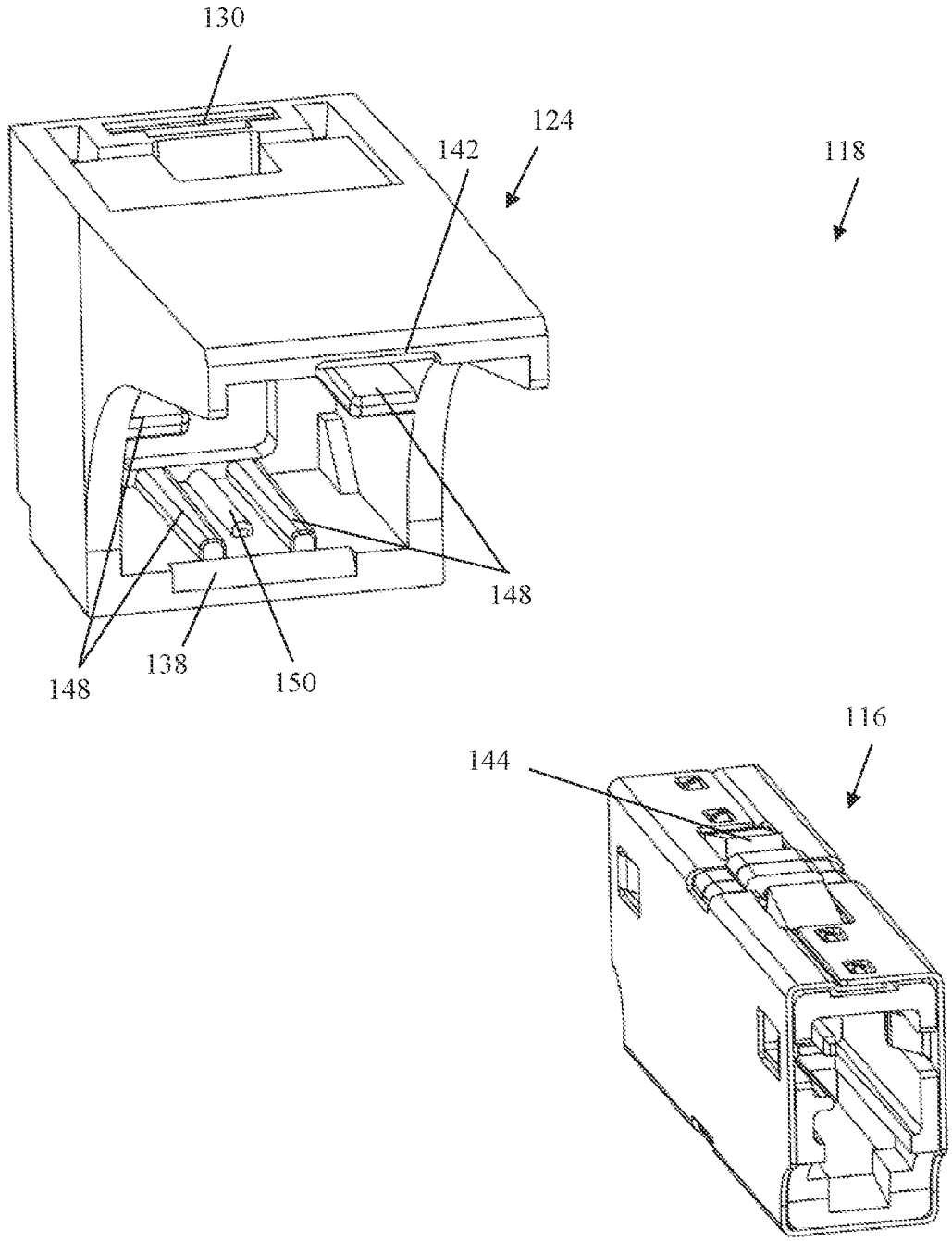
FIG. 13 is a rear exploded view of the single port coupler assembly of FIG. 11.
Figure 14:
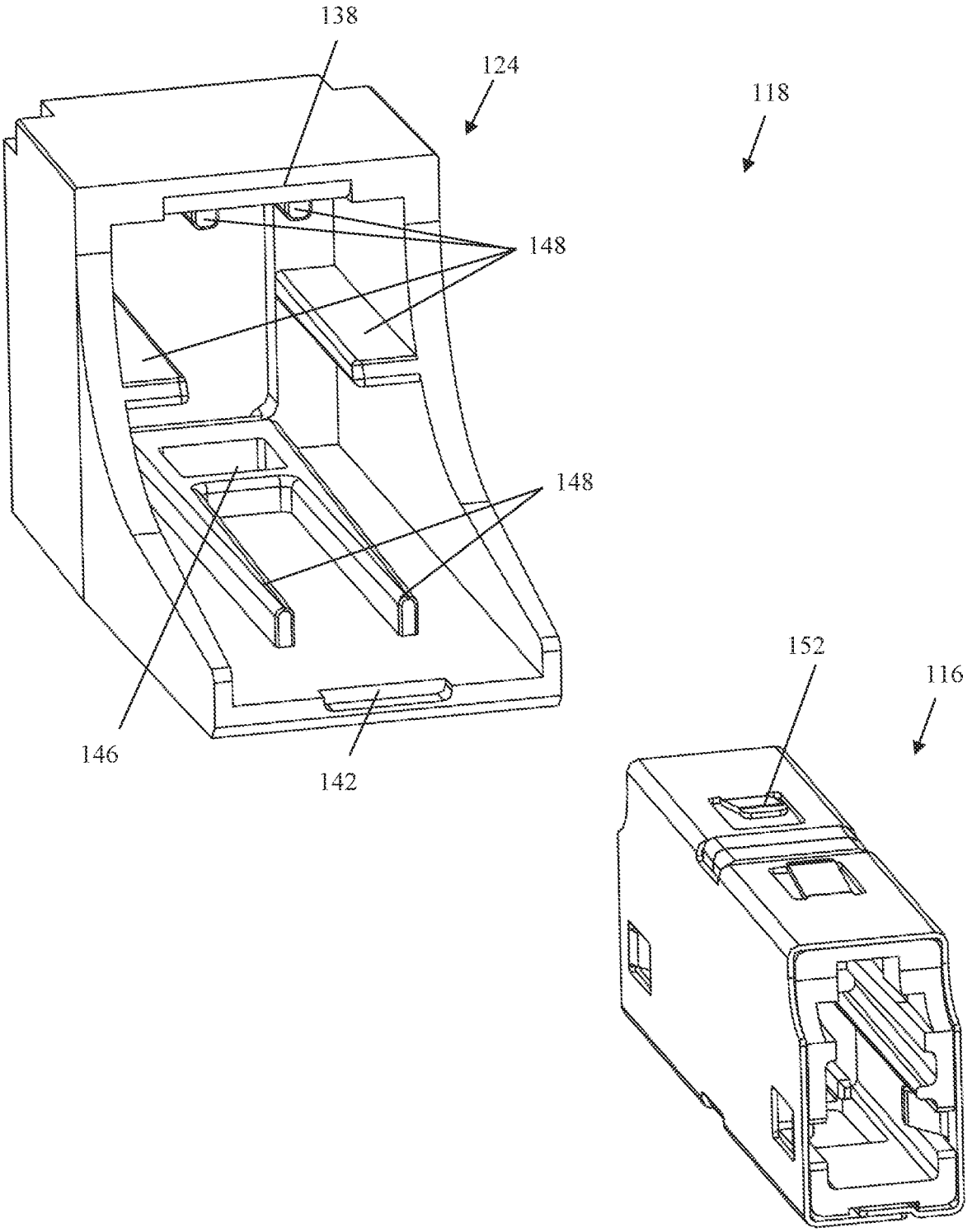
FIG. 14 is a rotated rear exploded view of the single port coupler assembly of FIG. 11.

FIG. 13 is a rear exploded view of single port coupler assembly 118. FIG. 14 is a rotated rear exploded view of single port coupler assembly 118. Latch 144 on SPE coupler 116 locks into pocket 146 of single port Mini-Corn adapter 124. Support ribs 148 on single port Mini-Corn adapter 124 help to hold. SPE coupler 116 in place after assembly. Grounding rib 150 on single port Mini-Com adapter 124 is designed to make contact with grounding tab 152 on SPE coupler 116 to create a fully bonded component if single port Mini-Corn adapter 124 is made from a die cast material. This will also allow single port Mini-Corn adapter 124 to be fully bonded with communications hardware 122 when communications hardware 122 is designed for an STP application.

Figure 15:
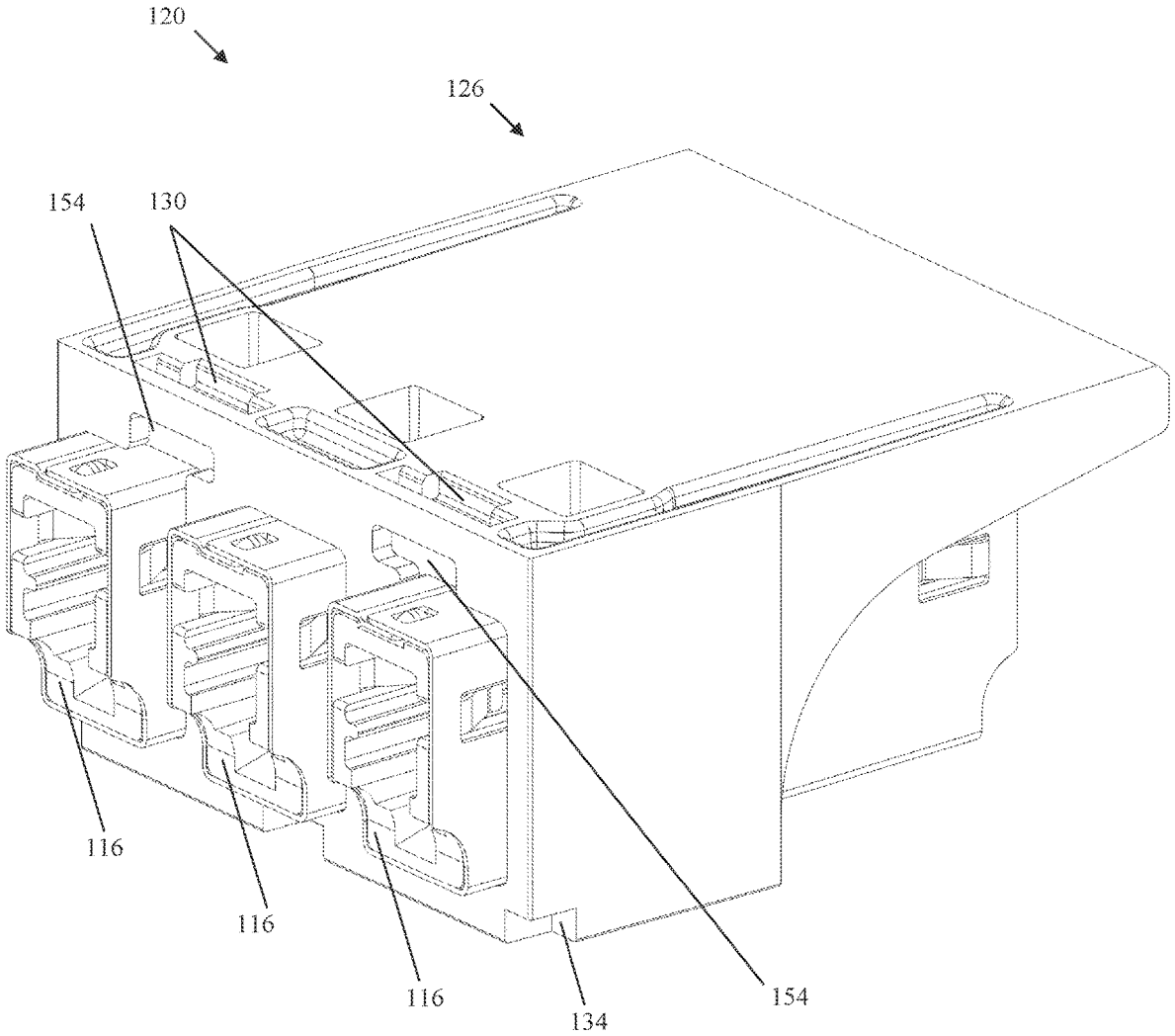
FIG. 15 is an isometric view of a two-port coupler assembly
Figure 16:
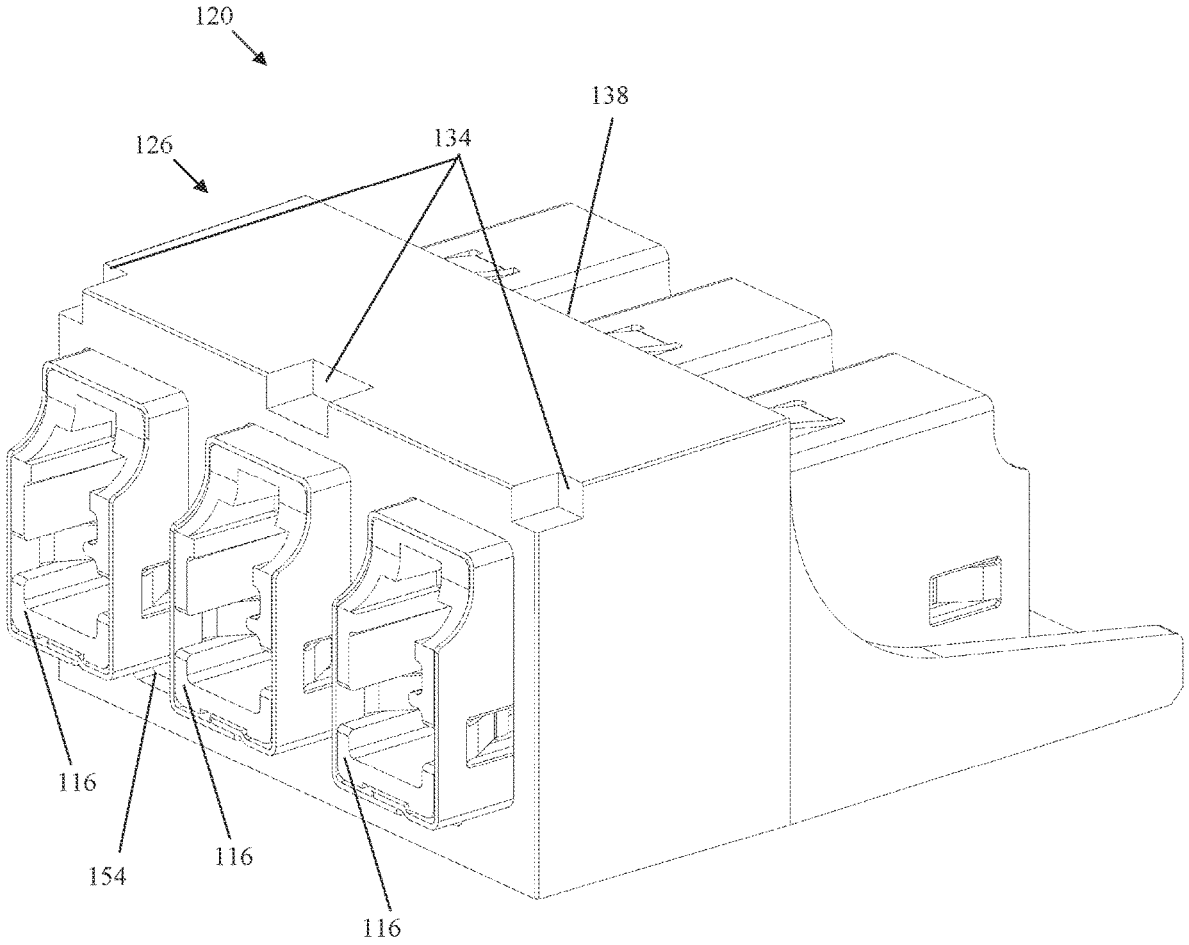
FIG. 16 is a rotated isometric view of the wo-port coupler assembly of FIG. 15.

FIG. 15 is an isometric view of two-port coupler assembly 120. FIG. 16 is a rotated isometric view of two-port coupler assembly 120. Two-port Mini-Com adapter 126 has pockets 154 and notches 156 to accommodate installation into surface mount boxes and other such equipment.

Figure 17:
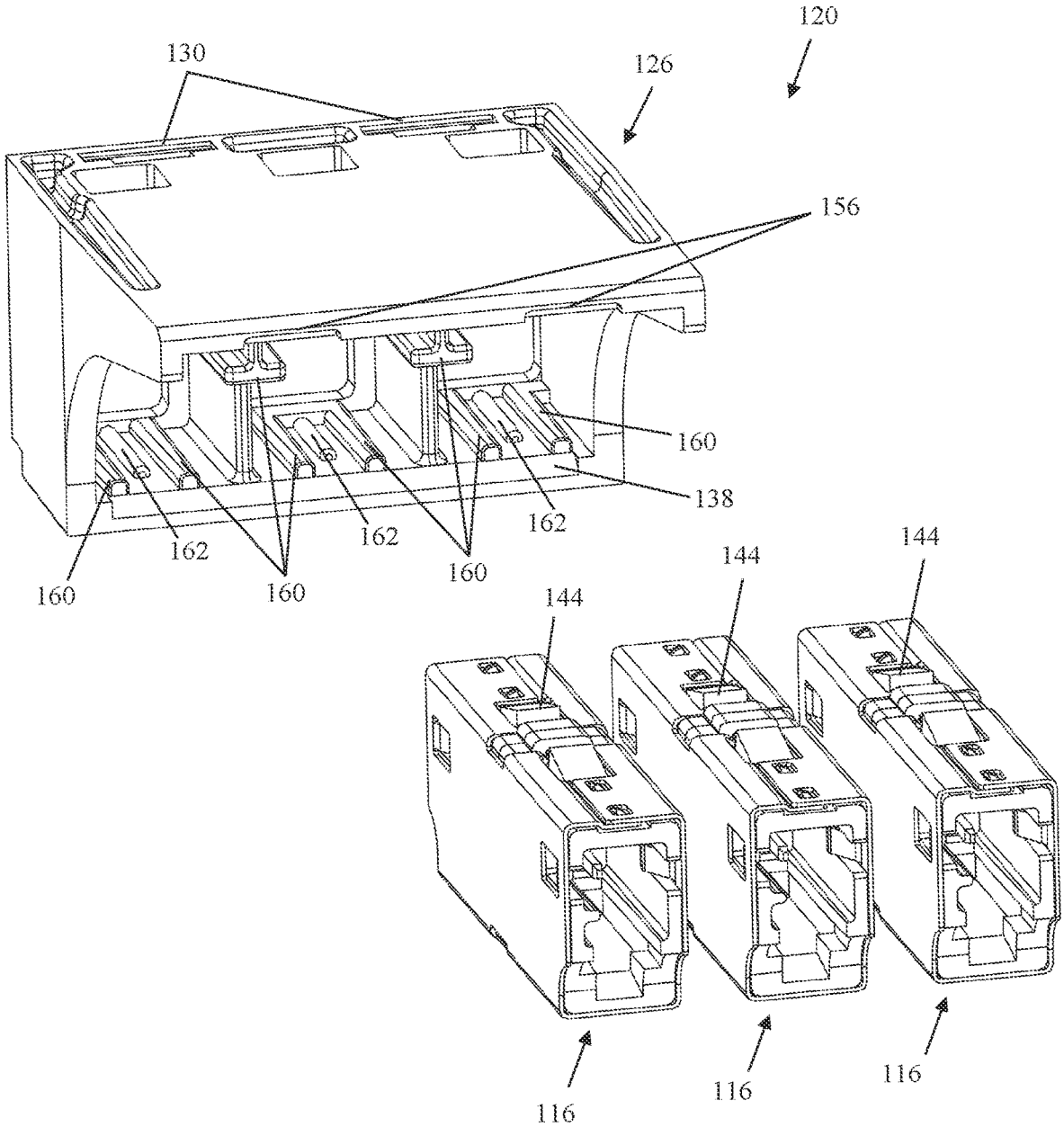
FIG. 17 is a rear exploded view of the two-port coupler assembly of FIG. 15.
Figure 18:
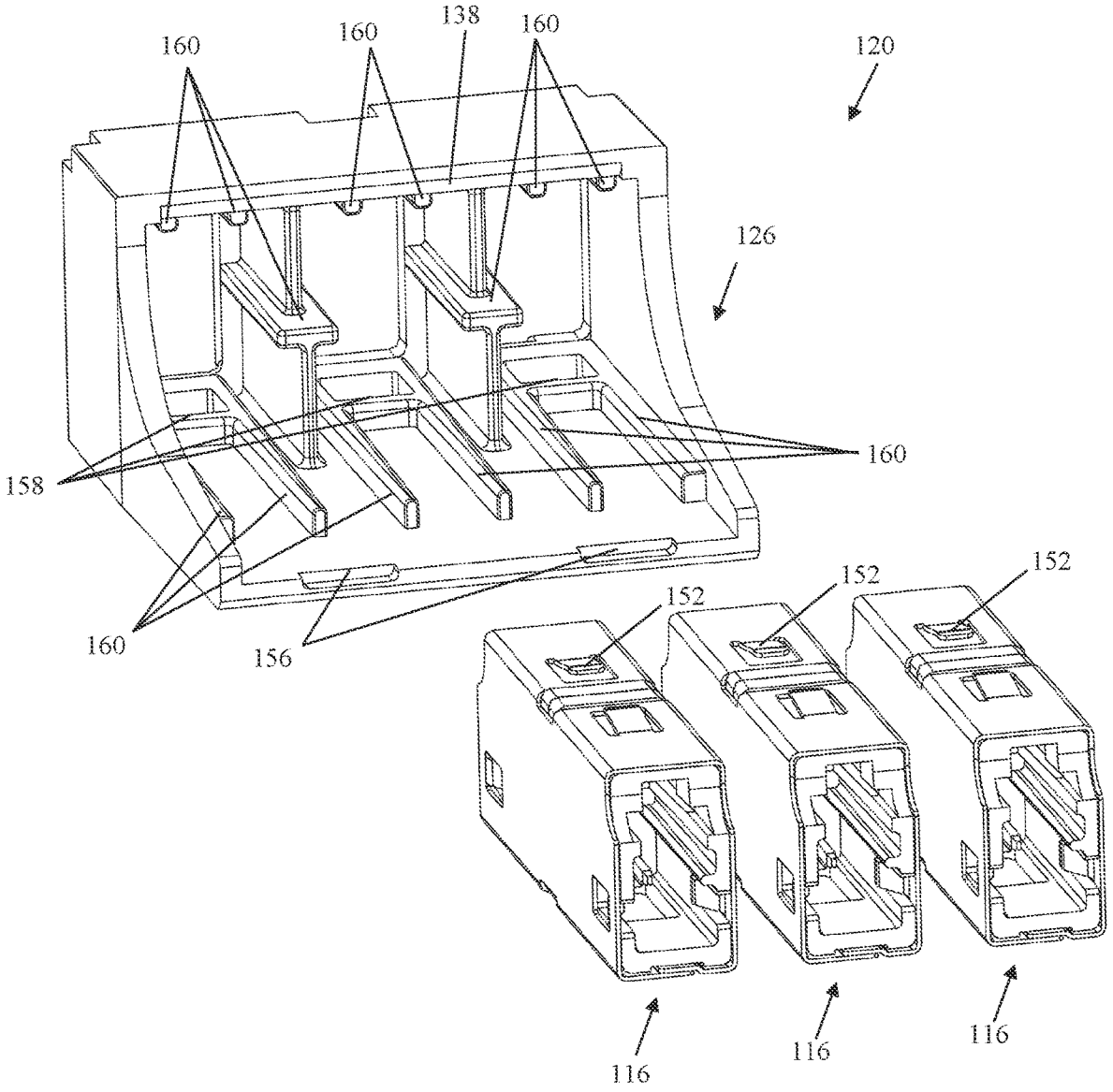
FIG. 18 is a rotated rear exploded view of the two-port coupler assembly of FIG. 15.

FIG. 17 is a rear exploded view of two-port coupler assembly 120. FIG. 18 is a rotated rear exploded view of two-port coupler assembly 120. Two-port Mini-Corn adapter 126 is designed to fit within the space of two Mini-Corn jack ports and will allow the installation of three SPE couplers 116 which provides greater SPE cable density than using two single port Mini-Corn adapters 124 within the same space (FIG. 8). Latches 144 on SPE couplers 116 lock into pockets 158 of two-port Mini-Corn adapter 126. Support ribs 160 on two-port Mini-Corn adapter 126 help to hold SPE couplers 116 in place after assembly. Grounding ribs 162 on two-port Mini-Com adapter 126 are designed to make contact with grounding tabs 152 on SPE couplers 116 to create a fully bonded component if two-port Mini-Corn adapter 126 is made from a die cast material. This will also allow two-port Mini-Corn adapter 126 to be fully bonded with communications hardware 122 when communications hardware 122 is designed for an STP application.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. An electrical coupler comprising:

first and second housing halves each housing half having a front opening and a rear wall, the rear wall of the first housing half configured to abut the rear wall of the second housing half when the first and second housing halves are secured together; and first and second contacts retained within the first and second housing halves such that each contract extends from the opening of the first housing half, through the rear wall of the first housing half, through the rear wall of the second housing half, and into the opening of the second housing half wherein the first housing half is identical to the second housing half and the first contact is identical to the second contact wherein each of the first and second housing half has a latch protruding from a rear face of the housing half proximate to a first side of the housing and a catch located on a second side of the housing wherein the first side is opposite the second side and further wherein the latch of the first housing half is configured to engage the catch of the second housing half and the latch of the second housing half is configured to engage the catch of the first housing half.

2. The electrical coupler of claim 1 wherein the first contact is rotated 180° relative to the second contact.

3. The electrical coupler of claim 1 wherein each of the first and second contacts have first and second 90° bends.

4. The electrical connector of claim 1 further comprising a shield wrap enclosing the first and second housing halves.

* * * * *